US012768110B2

(12) United States Patent
Nau et al.

(10) Patent No.: US 12,768,110 B2
(45) Date of Patent: Oct. 20, 2026

(54) ASYMMETRICALLY SILICA-IMPREGNATED NONWOVEN FABRICS AND METHODS FOR PRODUCING SAID NONWOVENS AND USE THEREOF

(71) Applicant: TECHNISCHE UNIVERSITAT DARMSTADT, Darmstadt (DE)

(72) Inventors: Maximilian Nau, Mühltal (DE); Markus Biesalski, Maintal (DE); Nicole Herzog, Obertshausen (DE); Annette Andrieu-Brunsen, Darmstadt (DE)

(73) Assignee: TECHNISCHE UNIVERSITÄT DARMSTADT, Darmstadt (DE)

( * ) Notice: Subject to any disclaimer, the term of this patent is extended or adjusted under 35 U.S.C. 154(b) by 772 days.

(21) Appl. No.: 17/281,398

(22) PCT Filed: Sep. 25, 2019

(86) PCT No.: PCT/EP2019/075927

§ 371 (c)(1),
(2) Date: Mar. 30, 2021

(87) PCT Pub. No.: WO2020/069943

PCT Pub. Date: Apr. 9, 2020

(65) Prior Publication Data

US 2022/0034041 A1 Feb. 3, 2022

(30) Foreign Application Priority Data

Oct. 1, 2018 (DE) ..... 10 2018 124 255.7

(51) Int. Cl.
*D21H 25/06* (2006.01)
*D06M 11/79* (2006.01)
(Continued)

(52) U.S. Cl.
CPC ..... *D21H 25/06* (2013.01); *D06M 11/79* (2013.01); *D06M 23/16* (2013.01); *D21H 19/40* (2013.01);
(Continued)

(58) Field of Classification Search
CPC ..... D21H 17/13; D21H 19/40; D21H 19/00
(Continued)

(56) References Cited

U.S. PATENT DOCUMENTS 2,399,981 A * 5/1946 Britt ..... D21H 17/70 162/173
9,783,930 B2 * 10/2017 Luna Marroquín ... D21H 17/67
(Continued)

FOREIGN PATENT DOCUMENTS

EP 1 262 586 12/2002
EP 1 944 351 7/2008
(Continued)

OTHER PUBLICATIONS

Zhao Li et al., "Fabrication of Food-Safe Water-Resistant Paper Coatings Using a Melamine Primer and Polysiloxane Outer Layer," Sep. 25, 2018, ACS Omega 2018, 3, 11909-11916. (Year: 2018).*
(Continued)

*Primary Examiner* — Peter Y Choi
(74) *Attorney, Agent, or Firm* — Wenderoth, Lind & Ponack, L.L.P.

(57) ABSTRACT

The present invention relates to fibrous non-woven fabrics with asymmetric silica impregnation and methods for their production as well as uses of the non-woven fabrics, in particularly in the field of packaging materials.

20 Claims, 1 Drawing Sheet

(51) Int. Cl.

| | |
|---|---|
| ***D06M 23/16*** | (2006.01) |
| ***D06M 101/06*** | (2006.01) |
| ***D21H 19/40*** | (2006.01) |
| ***D21H 19/46*** | (2006.01) |
| ***D21H 27/10*** | (2006.01) |

(52) U.S. Cl.
CPC ..... *D21H 19/46* (2013.01); *D21H 27/10* (2013.01); *D06M 2101/06* (2013.01); *D06M 2200/12* (2013.01)

(58) Field of Classification Search
USPC ..... 442/59, 79, 81
See application file for complete search history.

(56) References Cited

U.S. PATENT DOCUMENTS

| | | | | |
|---|---|---|---|---|
| 2010/0286582 | A1* | 11/2010 | Simpson | D06M 23/08 427/2.3 |
| 2018/0233121 | A1 | 8/2018 | Kim et al. | |

FOREIGN PATENT DOCUMENTS

| | | | | |
|---|---|---|---|---|
| GB | 1221976 | * | 2/1971 | C08L 61/20 |
| JP | 2017206777 A | * | 11/2017 | |
| KR | 1020160101330 | | 8/2016 | |
| WO | 2016/133328 | | 8/2016 | |

OTHER PUBLICATIONS

Machine translation for JP 2017206777. (Year: 2017).*
International Search Report, issued Dec. 10, 2019 in corresponding International Patent Application No. PCT/EP2019/075927.
European Search Report, issued Jul. 15, 2020 in corresponding European Patent Application No. 19 778 972.0, with English language translation.
German Search Report, issued Jun. 4, 2019 in corresponding European Patent Application No. 10 2018 124 255.7, with English language translation.
Dubois et al., "Fluid Flow Programming in Paper-Derived Silica-Polymer Hybrids", Langmuir, 33: 332-339 (2017).

* cited by examiner

ASYMMETRICALLY SILICA-IMPREGNATED NONWOVEN FABRICS AND METHODS FOR PRODUCING SAID NONWOVENS AND USE THEREOF

The present invention relates to fibrous non-woven fabrics with asymmetric silica impregnation and methods for their production as well as uses of the non-woven fabrics, in particularly in the field of packaging materials.

Modification of non-woven paper fabrics for changing the surface properties has been described in many ways. Normally, composite materials are provided, where on the surface of the non-woven paper fabric a modifying layer is present. For example, composite materials made of paper and polyethylene are known. These composite materials are obtained by laminating polyethylene foils onto the paper surface. So, layer composites are created which on one side or on both sides are characterized by hydrophobic surface properties. An anisotropic distribution of the chemical impregnation within the non-woven paper fabric cannot be achieved with these techniques. Furthermore, such composite materials can only hardly or not at all be recycled (cue: micro plastics). Particularly disadvantageous are also the relatively large amounts of material which are required for, e.g., a coating.

It is also possible to hydrophobize papers with so-called sizing agents (for example alkylated ketene dimers (AKD)). However also in this connection, till today, the adjustment of a chemical, anisotropic gradient has not been described, presumable due to the fact that the molecules statistically only react with the functions on the fibers, but not with each other.

A further possibility for changing the surface properties of a non-woven paper fabric is described in Dubois et al. (*Langmuir,* 2017, 33 (1), p. 332-339). A hybrid material made of paper and $SiO_2$ is disclosed, which in comparison to non-modified paper has considerably more hydrophobic surface properties. However, a $SiO_2$ gradient is not described. Thus, the disclosed materials have neither surfaces with different water absorption properties nor a comparatively hydrophilic core. Presumably, the reason for that is that the non-woven fabrics after the application of the impregnating solution at first for a relatively long period of time are kept at low temperatures so that a polymeric impregnation which is distributed uniformly across the surface and the interior of the non-woven fabric can be formed, before the solvent evaporates to a substantial extent.

However, an anisotropic distribution of the chemical impregnation which can also be referred to as asymmetric distribution would be associated with multiple advantages. Thus, it would be possible to apply functional coatings in much lower application weights with the same effect. In addition, the targeted adjustment of the material concentration would allow the generation of more complex structures (e.g., sandwich-like built channels in the paper) in one process step with the use of a minimum amount of material. By the anisotropic chemical structure advantageous property profiles in the non-woven fabrics, for example barrier effects, would result. For example, it would be possible to obtain a non-woven fabric which from outside cannot be wetted with fluids (for example water), but, however, inside can absorb (and release, convey, and so on . . . ) the same fluid, such as also described below.

It is an object of the present invention to overcome the disadvantages of the state of the art. In particularly, fibrous non-woven fabrics, for example non-woven paper fabrics, should be provided which are functionalized such that they in cross section have chemically anisotropic properties. It should be possible to manufacture the non-woven fabrics with a method which allows to confer localized hydrophobic or hydrophilic properties to the fibers, in particularly paper fibers. The method should be simple and it should allow an uncomplicated upscaling. In addition, biocompatible materials should be obtained, contrary to the polymer layerings which are known from the state of the art. The distribution of $SiO_2$ in the form of a gradient allows that one side of the non-woven fabric, in particularly of the paper, absorbs water and the other side repels water, or that both surfaces repel water and that only inside the material water can be absorbed, analogously to a chemical sandwich structure. In addition, by an adjustment of the amount of $SiO_2$ the water absorption behavior can be adjusted.

The objects are solved by the subject matters of the patent claims. The objects are in particularly solved by a fibrous non-woven fabric with asymmetric silica impregnation, wherein the non-woven fabric has two main surfaces, wherein the portion by weight of $SiO_2$ starting from at least one of both main surfaces towards the interior of the non-woven fabric decreases. The objects are also solved by a method for the production of a fibrous non-woven fabric with asymmetric silica impregnation, in particularly a fibrous non-woven fabric of the present invention, comprising the following steps:

a) providing of a fibrous non-woven fabric, b) providing of an impregnating solution, wherein the impregnating solution contains a silane component, c) impregnating of the non-woven fabric with the impregnating solution, d) drying of the non-woven fabric at temperatures in a range of 70° C. to 190° C., wherein there is a period of time of at most 60 seconds between the completion of the impregnating according to step c) and the beginning of the drying according to step d).

Preferably, the method which has been developed by the inventors uses for the build-up of the anisotropic (asymmetric) impregnation only a silane component (in particularly tetraethyl orthosilicate (TEOS), preferably pre-polymerized) as well as a fibrous non-woven fabric, in particularly a non-woven paper fabric. The silane component can be introduced into the paper in a simple immersion step. Other impregnating methods are also possible. Preferably, the impregnating of the non-woven fabric with the impregnating solution is conducted according to step c) of the method with an impregnating method which is selected from the group consisting of immersion coating, spray coating (optionally also on both sides), size press, roller coating, blade coating and curtain coating. Immersion coating and spray coating are particularly preferred. Especially preferred is immersion coating. Preferably, the impregnating solution is uniformly distributed across the surface and the interior of the non-woven fabric.

During the subsequent drying step, from the silane component a silica impregnation in the form of polymeric $SiO_2$ which can also be referred to as silicate component is formed. This is not only the result of the drying, but of a chemical reaction which takes place concurrently. The distribution of the amount of polymeric silicate component is preferably controlled by the drying process which particularly preferably includes the control of the condensation reaction of the silane component (in particularly TEOS) which takes place concurrently with the drying. Different from papers which are known from the state of the art, the localization of the impregnation is preferably controlled by the self-diffusion and reactivity of the silane component which in turn easily can be adjusted via the drying conditions (air humidity, temperature, pressure). Thus, it is not necessary to produce a laminate in multiple steps with many additives.

The method allows the economy of process steps as well as introduced amount of material and thus of energy as well as materials on the basis of fossil raw materials. Furthermore, the novel materials which can be obtained by the method can be used in a variety of ways, such as for example for the hydrophobization in the field of packaging and foodstuff.

The present invention relates to a fibrous non-woven fabric with asymmetric silica impregnation, wherein the non-woven fabric comprises two main surfaces, wherein the portion by weight of $SiO_2$ starting from at least one of both main surfaces towards the interior of the non-woven fabric decreases.

The non-woven fabric of the present invention is a fibrous non-woven fabric. Preferably, the fibrous non-woven fabric is selected from the group consisting of non-woven paper fabrics, non-woven textile fabrics and non-woven plastic fabrics. Particularly preferably, the non-woven fabric is a non-woven paper fabric.

Preferably, the impregnated fibrous non-woven fabric comprises $SiO_2$ in a portion of 0.1 to 10% by weight, further preferably of 0.2 to 7.5% by weight, further preferably of 0.5 to 5% by weight. Preferably, the impregnated fibrous non-woven fabric consists of the fiber component (in particularly paper) and the impregnating component ($SiO_2$). Preferably, the impregnated fibrous non-woven fabric comprises the fiber component in a portion of 90 to 99.9% by weight, further preferably of 92.5 to 99.8% by weight, further preferably of 95% by weight to 99.5% by weight.

Preferably, the impregnated fibrous non-woven fabric of the invention consists of the fiber component (in particularly paper) and the impregnating component ($SiO_2$). The non-woven fabric may contain further components, preferably however in a portion of at most up to 50% by weight, such as for example 0 to 30% by weight, further preferably up to 25% by weight, further preferably up to 10% by weight, further preferably up to 5% by weight, further preferably up to 2% by weight, further preferably up to 1% by weight, further preferably less than 0.5% by weight. These further components may in particularly be inorganic and/or organic fillers.

Preferably, the portion of the fiber component and the impregnating component in the non-woven fabric of the present invention is at least 50% by weight, further preferably at least 75% by weight, further preferably at least 90% by weight, further preferably at least 95% by weight, further preferably at least 98% by weight, further preferably at least 99% by weight. Preferably, the impregnated fibrous non-woven fabric of the invention consists of the fiber component and the impregnating component.

The non-woven fabric of the present invention comprises an asymmetric (anisotropic) silica impregnation. In the present description, the terms "asymmetric" and "anisotropic" are used in a synonymous sense. The silica impregnation is in the form of polymeric $SiO_2$ which may also be referred to as silicate component. The silica impregnation is asymmetric, thus anisotropic. This means that the portion of $SiO_2$ is not homogenously distributed in the non-woven fabric, such as explained in detail in the following.

The non-woven fabric of the invention comprises two main surfaces. In other words, length and width of the non-woven fabric, or in the case of non-woven fabrics with round surface area the diameter of the non-woven fabric, are many times larger than the thickness of the non-woven fabric. Preferably, the ratio of length and width or diameter of the non-woven fabric to the thickness of the non-woven fabric is at least 5, further preferably at least 10, further preferably at least 20. Therefore, the form of the non-woven fabric can also be described as leaf-like, foil-like, plate-like or disc-like. Depending on the orientation of the non-woven fabric, the two main surfaces can also be referred to as upper and lower side or also as front and back side of the non-woven fabric.

In particularly preferable embodiments, the portion by weight of $SiO_2$ starting from at least one of both main surfaces decreases towards the interior of the non-woven fabric. Thus, the portion by weight of $SiO_2$ is at least at one of both main surfaces higher than the portion by weight of $SiO_2$ below the respective main surface. In other words, there is a $SiO_2$ gradient. The formation of such a $SiO_2$ gradient results in many advantages in comparison to materials with a distribution of the present $SiO_2$ which is substantially uniform across the thickness of the non-woven fabric. For example, internal channels and/or different wetting properties of the surfaces can be obtained. In addition, the use of a low amount of material becomes possible. Preferably, the portion by weight of $SiO_2$ at at least one of both main surfaces is at least 1.1 times as high, further preferably at least two times as high, further preferably at least three times as high, further preferably at least four times as high, further preferably at least five times as high, further preferably at least six times as high, further preferably at least seven times as high, further preferably at least eight times as high, further preferably at least nine times as high, further preferably at least ten times as high as the portion by weight of $SiO_2$ in the center of the non-woven fabric. The center of the non-woven fabric denotes the positions in the interior of the non-woven fabric which each are equidistant from the two main surfaces in the shortest possible connection, which thus are, based on the thickness of the non-woven fabric, in the center of the non-woven fabric.

Particularly preferably, the $SiO_2$ not only with respect to the one main surface, but also with respect to the other main surface is present in a gradient distribution. However, it is not necessary that the gradients which are formed from both main surfaces towards the interior of the non-woven fabric are of the same kind.

In certain preferred embodiments, the portion by weight of $SiO_2$ starting from one of both main surfaces decreases towards the interior of the non-woven fabric, while the portion by weight of $SiO_2$ starting from the other of both main surfaces increases towards the interior of the non-woven fabric. Such non-woven fabrics preferably differ with respect to their properties at both main surfaces. In particularly, for certain uses it is advantageous, when one main surface is considerably more hydrophobic than the other main surface. In such embodiments, particularly preferable is a non-woven fabric having a hydrophobic main surface and a hydrophilic main surface. Preferably, the portion by weight of $SiO_2$ at one of both main surfaces is at least 1.1 times as high, further preferably at least two times as high, further preferably at least three times as high, further preferably at least four times as high, further preferably at least five times as high, further preferably at least six times as high, further preferably at least seven times as high, further preferably at least eight times as high, further preferably at least nine times as high, further preferably at least ten times as high as the portion by weight of $SiO_2$ in the center of the non-woven fabric. Preferably, the portion by weight of $SiO_2$ at the other of both main surfaces is at most the 0.9-fold, further preferably at most the half, further preferably at most one third, further preferably at most one fourth, further preferably at most one fifth, further preferably at most one sixth, further preferably at most one seventh, further preferably at most one eighth, further preferably at most one ninth, further preferably at most one tenth of the portion by weight of $SiO_2$ in the center of the non-woven fabric. Preferably, the portion by weight of $SiO_2$ at one of both main surfaces is at least the 1.2-fold, further preferably at least the 4-fold, further preferably at least the 10-fold, further preferably at least the 20-fold, further preferably at least the 50-fold, further preferably at least the 100-fold of the portion by weight of $SiO_2$ at the other of both main surfaces.

In other preferred embodiments, the portion by weight of $SiO_2$ starting from both main surfaces decreases towards the interior of the non-woven fabric. Such non-woven fabrics preferably do not or do not substantially differ with respect to their properties at both main surfaces. In particularly, for certain uses it is advantageous, when both main surfaces are hydrophobic. In such embodiments, a non-woven fabric with two hydrophobic main surfaces is particularly preferable. Less material is required in comparison to a uniform impregnation across the whole thickness of the non-woven fabric. Preferably, the portion by weight of $SiO_2$ at both main surfaces is at least 1.1 times as high, further preferably at least 1.2 times as high, further preferably at least 1.5 times as high as the portion by weight of $SiO_2$ in the center of the non-woven fabric. Preferably, the ratio of the portion by weight of $SiO_2$ at the one main surface to the portion by weight of $SiO_2$ at the other main surface is in a range of 0.95:1 to 1.05:1, further preferably of 0.98:1 to 1.02:1, further preferably of 0.99:1 to 1.01:1.

The relative $SiO_2$ distribution in the non-woven fabrics is preferably analyzed with the help of confocal laser scanning microscopy (CLSM, English: "confocal laser scanning microscopy") at cross sections of embedded samples. In combination with absolute $SiO_2$ amounts per non-woven fabric which are preferably measured with the help of thermogravimetric analysis (TGA), this allows a quantitative statement about the amounts of material per volume increment.

Preferably, the non-woven fabrics of the invention have high flexibility.

The present invention also relates to a method for the production of a fibrous non-woven fabric with asymmetric silica impregnation, in particularly a non-woven fabric of the present invention such as described above. The invention also relates to a fibrous non-woven fabric with asymmetric silica impregnation which can be obtained or has been obtained by the method. The method comprises the following steps:

a) providing of a fibrous non-woven fabric, b) providing of an impregnating solution, wherein the impregnating solution contains a silane component, c) impregnating of the fibrous non-woven fabric with the impregnating solution, d) drying of the non-woven fabric at temperatures in a range of 70° C. to 190° C., wherein there is a period of time of at most 60 seconds between the completion of the impregnating according to step c) and the begin of the drying according to step d).

According to step a) of the method according to the present invention, a fibrous non-woven fabric is provided. Preferably, the fibrous non-woven fabric is selected from the group consisting of non-woven paper fabrics, non-woven textile fabrics and non-woven plastic fabrics. Particularly preferably, the fibrous non-woven fabric is a non-woven paper fabric. Preferably, the provided non-woven paper fabric has a grammage of 65 to 120 g/m$^2$, further preferably of 70 to 100 g/m$^2$, further preferably of 75 to 90 g/m$^2$.

The fibrous non-woven fabric can be a commercially available fibrous non-woven fabric. In particularly, the non-woven paper fabric can be a commercially available non-woven paper fabric. In an alternative, the step of providing the fibrous non-woven fabric, in particularly the non-woven paper fabric, can also contain the step of the production of the fibrous non-woven fabric, in particularly the non-woven paper fabric. The production of a non-woven paper fabric is preferably conducted with the Rapid-Köthen method, particularly preferably in a sheet forming Rapid-Köthen plant, especially preferably according to DIN 54358 and/or ISO 5269/2 (IS05269-2:2004(E), "Pulps—Preparation of Laboratory Sheets for Physical Testing—Part 2: Rapid Köthen Method, 2004").

Preferably, in the production of the fibrous non-woven fabric, in particularly the non-woven paper fabric, no further additives or fillers are used.

According to step b) of the method according to the present invention, an impregnating solution which contains a silane component is provided. In the present description the terms "impregnating solution" and "impregnation solution" are used in a synonymous sense. The impregnating solution may be a single-component one, thus may consist of one single component. In such a case the impregnating solution may in particularly also be referred to as "impregnating fluid" or "impregnation fluid".

In certain preferred embodiments, the impregnating solution consists of the silane component. In other words, the portion of the silane component in the impregnating solution is 100% by weight. Thus, in particularly, the impregnating solution may be pure silane. In other preferred embodiments, the impregnating solution contains in addition to the silane component still at least one further component, for example a solvent component and/or an acid component.

Preferably, the portion of the silane component in the impregnating solution is in a range of 5% by weight to 100% by weight, further preferably 10% by weight to 99% by weight, further preferably 20% by weight to 98% by weight, further preferably 40% by weight to 97% by weight, further preferably 60% by weight to 96% by weight, further preferably 80% by weight to 95% by weight. Via the portion of the silane component the extent of the water repellent properties of the surfaces of the non-woven fabrics can be adjusted in a targeted manner. Higher portions of silane component are connected with more hydrophobic surface properties.

Preferably, the silane component is selected from the group consisting of tetraethyl orthosilicate (TEOS), tetramethyl orthosilicate, polydimethoxysiloxane, 1,2-bis(triethoxysilyl)ethane, tetramethyl orthosilicate (TMOS), silicon tetraacetate and mixtures of two or more thereof. Particularly preferable is the silane component TEOS. TEOS is a common basic chemical which is not expensive and readily available. Preferably, the silane component is pre-polymerized. The term "pre-polymerized" means that only oligomers have already been formed, but that the material is not yet completely polymerized.

Preferably, the impregnating solution contains solvents in a portion which is in a range of 0 to 98% by weight, further preferably of 0.1 to 50% by weight, further preferably of 0.2 to 20% by weight, further preferably of 0.5 to 10% by weight, still further preferably of 1 to 5% by weight. Preferably, the solvent is selected from the group consisting of water, ethanol and mixtures of two or more thereof. Particularly preferably, the solvent is water.

Preferably, the impregnating solution contains water in a portion which is in a range of 0 to 20% by weight, further preferably of 0.5 to 10% by weight, further preferably of 1 to 5% by weight.

Preferably, the impregnating solution contains HCl in a portion of 0.001 to 0.2% by weight, further preferably of 0.005 to 0.1% by weight, further preferably of 0.01 to 0.05% by weight.

Preferably, the impregnating solution according to the present invention consists of at least 95% by weight, further preferably at least 98% by weight, further preferably at least 99% by weight, further preferably at least 99.9% by weight, further preferably at least 99.99% by weight of ethanol, water, silane component and HCl. It is a special advantage of the method according to the present invention that no further components are required in the impregnating solution. Particularly preferably, the impregnating solution even consists of at least 95% by weight, further preferably at least 98% by weight, further preferably at least 99% by weight, further preferably at least 99.9% by weight, further preferably at least 99.99% by weight of water, silane component and HCl.

After the addition of the single components, the impregnating solution is preferably stirred for a period of time of 6 to 48 hours, further preferably of 12 to 36 hours, further preferably of 18 to 30 hours, before the impregnating of the fibrous non-woven fabric, in particularly the non-woven paper fabric, is conducted with the impregnating solution according to step c) of the method according to the present invention. In embodiments of the invention in which the impregnating solution consists of silane component (in particularly TEOS), preferably, no such stirring is conducted.

The step c) of the impregnating of the fibrous non-woven fabric, in particularly the non-woven paper fabric, with the impregnating solution is preferably conducted at a relative air humidity in a range of 10% to 95%, further preferably of 30% to 70%, further preferably 40% to 60%, further preferably 45% to 55% and/or at a temperature in a range of 15° C. to 30° C., further preferably 20° C. to 25° C.

Preferably, the impregnating of the fibrous non-woven fabric with the impregnating solution is realized by exposing the non-woven fabric to the impregnating solution, thus in other words, by bringing the non-woven fabric into contact with the impregnating solution. For the design of this step of contacting the non-woven fabric with the impregnating solution there are many possibilities. Preferably, the impregnating of the fibrous non-woven fabric with the impregnating solution according to step c) of the method is realized with an impregnating method which is selected from the group consisting of immersion coating, spray coating (optionally also on both sides), size press, roller coating, blade coating and curtain coating. Immersion coating and spray coating are particularly preferred. Especially preferred is immersion coating. Preferably, the impregnating solution is uniformly distributed across the surface and the interior of the non-woven fabric.

According to embodiments of the invention, the impregnating in step c) of the invention is realized by immersing the non-woven fabric into the impregnating solution. Preferably, in such embodiments, the fibrous non-woven fabric, in particularly the non-woven paper fabric, is completely immersed into the impregnating solution. Preferably, the immersion is conducted such that the fibrous non-woven fabric, in particularly the non-woven paper fabric, is substantially vertically oriented. A vertical orientation means, in other words, that both main surfaces of the non-woven fabric are arranged such that surface vectors which are orthogonal with respect to the main surfaces are substantially horizontally oriented. Preferably, the surface vectors of both main surfaces with the vector of the immersion direction each form an angle of at least 70° and at most 110°, further preferably of at least 80° and at most 100°, further preferably of at least 85° and at most 95°.

Preferably, the removal of the non-woven fabric from the impregnating solution is conducted at a time point one to ten seconds, further preferably two to five seconds after the completion of the immersion of the non-woven fabric into the impregnating solution.

Preferably, the removal of the non-woven fabric from the impregnating solution is conducted such that the non-woven fabric is substantially vertically oriented. A vertical orientation means, in other words, that both main surfaces of the non-woven fabric are arranged such that surface vectors which are orthogonal with respect to the main surfaces are substantially horizontally oriented. Preferably, the surface vectors of both main surfaces with the vector of the removal direction each form an angle of at least 70° and at most 110°, further preferably of at least 80° and at most 100°, further preferably of at least 85° and at most 95°.

According to step d) of the method according to the present invention, the drying of the non-woven fabric is conducted at temperatures in a range of 70° C. to 190° C. Preferably, the drying of the non-woven fabric is conducted at temperatures in a range of 80° C. to 180° C., further preferably of 90° C. to 170° C., further preferably of 100° C. to 160° C., further preferably of 110° C. to 150° C., further preferably of 120° C. to 140° C., further preferably of 125° C. to 135° C. Preferably, the drying of the non-woven fabric according to step d) is conducted, until the residual moisture content of the non-woven fabric is in a range of 3% by weight to 7% by weight. Preferably, the residual moisture content is determined by means of gravimetric analysis, in particularly according to DIN EN 20287.

Between the completion of the impregnating according to step c) and the begin of the drying according to step d) there is a period of time of at most 60 seconds, preferably at most 45 seconds, further preferably at most 30 seconds, further preferably at most 20 seconds, further preferably at most 10 seconds, further preferably at most 5 seconds, further preferably at most 2 seconds, further preferably at most 1 second. Preferably, the drying according to step d) of the method according to the present invention is conducted immediately, in other words directly, after the impregnating of the non-woven fabric with the impregnating solution according to step c) of the method.

Preferably, the impregnating according to step c) is finished, when the fibrous non-woven fabric is no longer exposed to the impregnating solution, or in other words, when the fibrous non-woven fabric is no longer brought into contact with the impregnating solution. In the case of immersion coating, for example, the impregnating according to step c) is preferably finished, when the fibrous non-woven fabric again has completely been removed from, for example pulled out of, the impregnating solution. In the case of spray coating, for example, the impregnating according to step c) is preferably finished, when the impregnating solution is no longer sprayed onto the non-woven fabric.

The drying according to step d) preferably begins, when the non-woven fabric enters an environment which is intended for removing humidity and/or condensation products, such as for example an oven.

Presumably, with the short period of time between the completion of the impregnating and the beginning of the drying it is achieved that the silane component of the impregnating solution has still not been converted in a substantial extent into the silicate component of the silica impregnation, when the drying is realized at the increased drying temperatures. This allows the targeted adjustment of the asymmetric silica impregnation. Because the silane component migrates at the increased drying temperatures depending on the drying conditions, in particularly the environmental pressures, through the non-woven fabric, as long as it has not been converted into a silica impregnation with a polymerization degree which is too high.

In embodiments in which the impregnating solution does not contain a solvent, the migration of the silane component through the non-woven fabric at the increased drying temperatures can in particularly be influenced by an adjustment of the environmental pressures during the drying. In embodiments in which the impregnating solution contains solvent(s), the migration of the silane component can in particularly also be influenced by the evaporation of the silane component and/or the solvent at the increased drying temperatures, because the silane component together with the solvent migrates through the non-woven fabric.

When the polymerization further progresses, then the mobility in the non-woven fabric is further reduced. Thus, when after the impregnating of the non-woven fabric with the impregnating solution there is a longer period of time, until the drying at the increased temperatures is started, thus when the period of time between the steps c) and d) of the method is relatively long, then this results in a substantial polymerization, before a relevant migration of the silane component through the non-woven fabric has taken place. This results in the fact that non-woven fabrics with a homogenous distribution of the silica impregnation are obtained, because the distribution of the already polymerized coating can no longer be influenced by the drying conditions at the increased drying temperatures.

Contrary to this, the method of the present invention is designed such that between the completion of the impregnating according to step c) and the beginning of the drying according to step d) a period of time of at most 60 seconds is provided. Therefore, at the begin of the drying a substantial polymerization has still not taken place so that the silane component which is present in the impregnating solution migrates through the non-woven fabric, and therefore via the migration the distribution of the silica impregnation can be influenced in a targeted manner. When, for example, drying conditions are chosen which result in an increased migration of the silane component to one of both main surfaces, for example by a reduced environmental pressure at one of both main surfaces in comparison to the other main surface, then it is possible to obtain fibrous non-woven fabrics with an asymmetric silica impregnation which is designed such that the portion by weight of $SiO_2$ at the one main surface is higher than in the center of the non-woven fabric, while the portion by weight of $SiO_2$ at the other main surface is lower than in the center of the non-woven fabric. However, when drying conditions are chosen which result in a comparable extent of migration to both main surfaces, such as for example by a low pressure at both main surfaces, then it is possible to obtain fibrous non-woven fabrics with an asymmetric silica impregnation which is designed such that the portion by weight of $SiO_2$ at both main surfaces is nearly the same, namely higher than in the center of the non-woven fabric, because the silane component migrates from the center into the direction of the main surfaces, and then there an increased formation of the polymeric silica impregnation takes place.

Preferably, the drying is achieved with the help of a dryer. Preferably, the dryer is selected from the group consisting of hot air dryers, ovens, drum dryers and IR dryers. For example, it can be dried in an oven, preferably in a vacuum oven or in a muffle furnace. Preferably, the oven is preheated, in particularly to the drying temperature so that after the impregnating according to step c) it is possible to start the drying according to step d) very quickly. However, particularly preferably, the dryer is a hot air dryer. Hot air drying is particularly preferred.

According to the present invention, the properties of the obtained non-woven fabrics cannot only be influenced by the above-mentioned method steps, but in particularly also by the prevailing environmental pressure during the drying. Surprisingly, it has been found that the distribution of the content of $SiO_2$ in the non-woven fabrics can be controlled in a targeted manner by the pressure conditions during the drying. Non-woven fabrics with relatively high contents of $SiO_2$ at both main surfaces can in particularly be obtained with low pressures. Higher pressures, on the other hand, support differences between the contents of $SiO_2$ of both main surfaces so that non-woven fabrics are obtained, where one of the main surfaces in comparison to the other main surface is considerably more hydrophobic.

Preferably, the pressure during the drying according to step d) is in a range of 0.1 kPa to 500 kPa, further preferably of 0.2 kPa to 200 kPa. In certain preferred embodiments, the pressure during the drying according to step d) is in a range of 0.1 kPa to 30 kPa, further preferably of 0.2 kPa to 20 kPa, further preferably of 0.5 kPa to 10 kPa, further preferably of 1 kPa to 5 kPa. Such embodiments are in particularly suitable for the production of such non-woven fabrics, where the content of $SiO_2$ at both main surfaces is relatively high and, however, in the center of the non-woven fabric is relatively low (so-called sandwich structure). On the other hand, in other preferred embodiments, the pressure during the drying according to step d) is in a range of >30 kPa to 500 kPa, further preferably of 50 kPa to 200 kPa, further preferably of 60 kPa to 150 kPa, further preferably of 70 kPa to 130 kPa, further preferably of 80 kPa to 120 kPa, further preferably of 90 kPa to 110 kPa. Such embodiments are in particularly suitable for the production of such non-woven fabrics, where the content of $SiO_2$ at one of both main surfaces is considerably higher than at the other of both main surfaces, while the content of $SiO_2$ in the center of the non-woven fabric is lower than at the one of both main surfaces, however higher than at the other of both main surfaces. This is in particularly true, when impregnating solutions with low or medium portions of silane component are used, in particularly with a portion of silane component in a range of 0.1% by mol to 3.5% by mol, further preferably of 0.2% by mol to 3% by mol, further preferably of 0.5% by mol to 2.5% by mol, further preferably of 0.9% by mol to 2.2% by mol.

Preferably, during the drying, the non-woven fabrics are substantially horizontally arranged or horizontally oriented. A horizontal orientation means, in other words, that both main surfaces of the non-woven fabric are arranged such that surface vectors which are orthogonal with respect to the main surfaces are substantially vertically oriented.

Preferably, after the drying, the non-woven fabrics are cooled to a temperature of 15° C. to 30° C., further preferably of 20° C. to 25° C.

Preferably, the method consists of the mentioned steps. It is a special advantage of the method according to the present invention that the method gets by with very few steps.

The present invention also relates to the use of a non-woven fabric of the present invention, in particularly as packaging material.

Preferred uses as packaging material comprise the use as freezing paper, the use for products which come into contact with foodstuffs, such as in particularly (paper) cups and/or (paper) straws, as well as the use as packaging for materials which are protected from liquid, but nevertheless should allow diffusion of moisture. In particularly, the non-woven fabrics of the present invention can be used for plastic-free straws and/or pasteboard cups. In view of possible regulations for the reduction of plastic wastes it can be assumed that there will be an increased demand for plastic-free products. Non-woven fabrics for the mentioned uses, in particularly for the use in drinking straws and cups, often are also referred to as specialty papers.

For the use as pasteboard cup especially such embodiments are suitable, where the content of $SiO_2$ at one of both main surfaces is considerably higher than at the other of both main surfaces. The main surface with the higher content of $SiO_2$ is suitable as the inner side of the cup due to its hydrophobicity, because due to the hydrophobic properties of the surface the liquid which is present in the cup is prevented from excessive entering the interior of the non-woven fabric. The more hydrophilic surface is well suited as outer surface of the cup, because it supports the printability.

For the use as straw especially such embodiments are suitable, where the content of $SiO_2$ at both main surfaces is relatively high, and in the center of the non-woven fabric however is relatively low (so-called sandwich structure). The high content of $SiO_2$ at both main surfaces prevents the liquid from excessive entering the interior of the non-woven fabric. The fact that the content of $SiO_2$ in the center of the non-woven fabric is relatively low allows an economy of material.

The present invention also relates to the use of a non-woven fabric of the present invention as membrane, in particularly as membrane for the separation water/oil. Such a membrane can in particularly be used for the spatial separation of mixtures consisting of a liquid, hydrophobic component (in particularly oil) and water.

The present invention also relates to the use of a non-woven fabric of the present invention as specialty paper for the use at increased temperatures, in particularly the use of a non-woven fabric of the present invention as baking paper.

EXAMPLES

1. Paper Production

Figure 1:
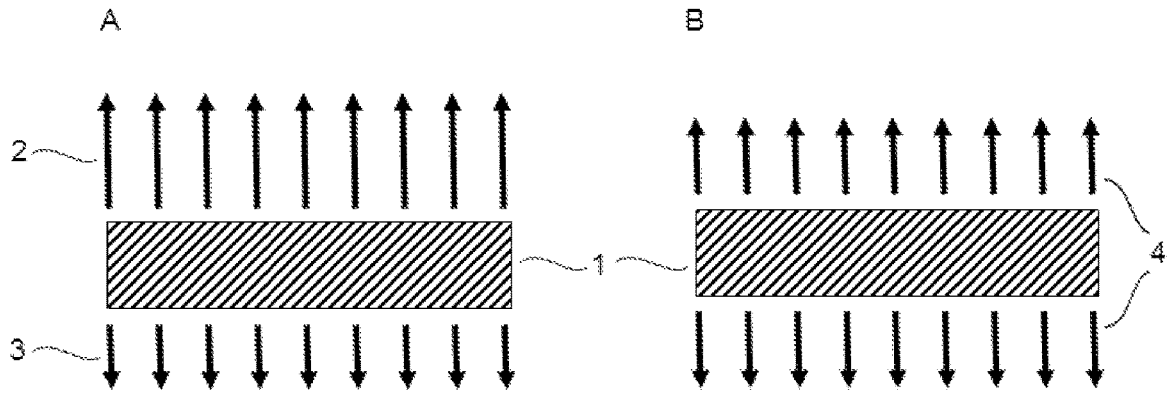
FIG. 1 shows schematically the evaporation from the non-woven fabrics (1) during drying under normal pressure (FIG. 1A) or in vacuum (FIG. 1B). Under normal pressure there was a high evaporation rate (2) at the upper side (illustrated by the longer arrows) and a low evaporation rate (3) at the lower side of the non-woven fabric (1) (illustrated by the shorter arrows). In vacuum at the upper and lower sides similarly a mean evaporation rate (4) results.
Figure 2:
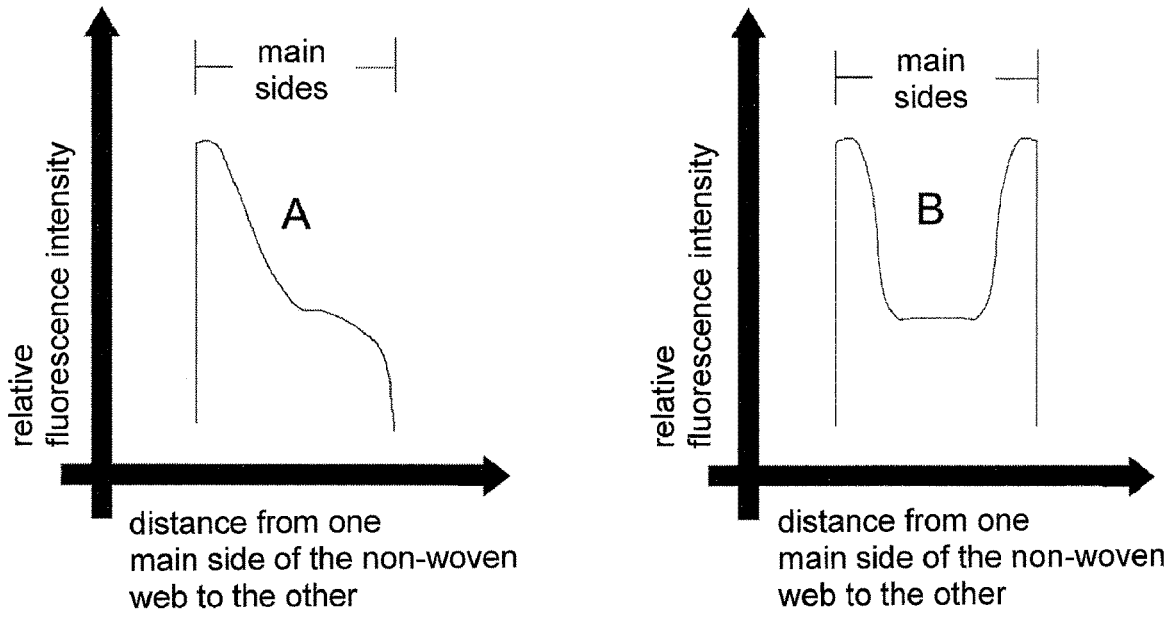
FIG. 2 shows schematically the fluorescence intensity (y-axis) of rhodamine B across the thickness of the non-woven fabrics (x-axis). The distribution is schematically outlined in FIG. 2A for non-woven fabrics which have been dried under normal pressure and in FIG. 2B for non-woven fabrics which have been dried in vacuum. The position of both main surfaces ("main sides") is given for orientation. The outline shows an exemplary fluorescence distribution in the case of fibrous non-woven fabrics with an asymmetric silica impregnation which is designed such that the portion by weight of $SiO_2$ at the one main surface is higher than in the center of the non-woven fabric, while the portion by weight of $SiO_2$ at the other main surface is lower than in the center of the non-woven fabric (FIG. 2A), and in the case of fibrous non-woven fabrics with an asymmetric silica impregnation which is designed such that the portion by weight of $SiO_2$ at both main surfaces is nearly the same, namely higher than in the center of the non-woven fabric (FIG. 2B).

For the production of a non-woven paper fabric fibrous *eucalyptus*-sulfate material ("curl": 16.2%; fibrillation degree: 1.3%; fines: 15.2%) was used. The fibrous material was ground in a Voith LR 40 laboratory refiner. It was ground with an effective specific energy of 16 kWh/t (750,000 rotations). From the fibrous *eucalyptus*-sulfate material non-woven paper fabrics having a grammage of 80±0.9 g/m$^2$ were prepared using a sheet forming Rapid-Köthen plant according to DIN 54358 and ISO 5269/2 (IS05269-2:2004 (E), "Pulps—Preparation of Laboratory Sheets for Physical Testing—Part 2: Rapid Köthen Method, 2004"). No additives or fillers were used.

2. Production of the $SiO_2$-Paper Hybrid Materials

Three different immersion solutions were provided, which in particularly differed with respect to the content of TEOS in the immersion solution and which in the following are referred to as low-concentrated, medium-concentrated and high-concentrated solution, respectively. The solutions contained TEOS, ethanol (EtOH), water ($H_2O$) and HCl in the following molar ratios:

| | |
|---|---|
| 1 TEOS:80 EtOH:20 $H_2O$:0.04 HCl | (low-concentrated solution) |
| 1 TEOS:40 EtOH:10 $H_2O$:0.02 HCl | (medium-concentrated solution) |
| 1 TEOS:20 EtOH:5 $H_2O$:0.01 HCl | (high-concentrated solution) |

These solutions were stirred for 24 hours and then they were used for the production of the $SiO_2$-paper hybrid materials. *Eucalyptus*-sulfate non-woven paper fabrics according to example 1 with a length of 8 cm and a width of 1 cm were immersed into the immersion solution at 50% relative air humidity and a temperature of 23° C. and were removed from the immersion solution with a velocity of 2 mm/s. Then, the non-woven fabrics were dried in horizontal orientation at a temperature of 130° C. for 2 hours, either in a vacuum oven or in a muffle furnace. Subsequently, the non-woven fabrics were cooled to room temperature.

3. Investigation of the Non-Woven Fabrics Made of $SiO_2$-Paper Hybrid Material

The non-woven fabrics obtained according to example 2 were used for different experiments for testing the properties of the non-woven fabrics.

a) Contact Angle

Contact angle measurements were conducted with the model TBU90E of DataPhysics Instruments GmbH and the SCA software. All samples were measured at five positions and the mean value and the standard deviation were calculated. For static contact angle measurements a drop volume of 2 μl was used (application rate: 1 μl/s). The results of the contact angle measurements with water are shown in the following table 1.

TABLE 1

| | | low silica concentration | medium silica concentration | high silica concentration |
|---|---|---|---|---|
| environmental pressure | upper side | hydrophilic | hydrophobic | hydrophobic |
| | lower side | hydrophilic | hydrophilic | hydrophobic |
| vacuum | upper side | hydrophilic | hydrophilic | hydrophobic |
| | lower side | hydrophilic | hydrophilic | hydrophobic |

In the case of the non-woven fabrics which were dried in the vacuum oven independently of the used TEOS solution no differences between the surface properties of the upper and lower sides were determined. The non-woven fabrics which were dried under environmental pressure in a muffle furnace also have not shown differences between the upper and lower sides, when the non-woven fabrics were obtained by a treatment with the low-concentrated TEOS solution or the high-concentrated TEOS solution. The low-concentrated TEOS solution resulted in non-woven fabrics with a hydrophilic wetting behavior at the upper and lower sides, while the high-concentrated TEOS solution resulted in a hydrophobic wetting behavior at the upper and lower sides. However, surprisingly, in the case of non-woven fabrics which were obtained by a treatment with the medium-concentrated TEOS solution, after drying under normal pressure, a different wetting behavior at the upper and lower sides has been shown. The upper side showed a hydrophobic wetting behavior and the lower side showed a hydrophilic wetting behavior. Thus, the non-woven fabric showed a kind of amphiphilic behavior or "Janus" behavior.

b) Thermogravimetric Analysis (TGA)

Thermogravimetric analysis was conducted with a TGA 1 (Mettler-Toledo). The samples were heated from 25° C. to 600° C. with a rate of 10° C./min under a constant air current of 30 ml/min. With these measurements it is possible to determine the content of $SiO_2$, because up to temperatures of 1700° C. $SiO_2$ is stable.

The results of the thermogravimetric analysis are summarized in the following table 2.

TABLE 1

| Sample | Weight loss (TGA) | Portion of $SiO_2$ |
|---|---|---|
| non-woven paper fabric of example 1 | 95.6% | — |
| non-woven fabric of example 2 (low-concentrated solution) | 95.0% | 0.60% |
| non-woven fabric of example 2 (medium-concentrated solution) | 93.67% | 1.93% |
| non-woven fabric of example 2 (high-concentrated solution) | 91.57% | 4.03% |

Thus, the portion of $SiO_2$ in the $SiO_2$-paper hybrid materials is about 0.6% by weight for the non-woven fabrics which were obtained by a treatment with the low-concentrated TEOS solution, and about 4% by weight for the non-woven fabrics which were obtained by a treatment with the high-concentrated TEOS solution.

c) Analysis of the $SiO_2$ Distribution

The relative $SiO_2$ distribution in the non-woven fabrics was analyzed with the help of confocal laser scanning microscopy (CLSM, English: "confocal laser scanning microscopy") at cross sections of embedded samples. In combination with the absolute $SiO_2$ distributions obtained in b) a quantitative statement about the amounts of material per volume increment can be made.

Aa) Production of the Non-Woven Fabrics

Non-woven fabrics were prepared such as described in the examples 1 and 2. But, prior to the treatment with the TEOS solution, for the production of the hybrid materials according to example 2 the dye Calcofluor White (CFW) was introduced into the non-woven fabrics in the follow manner:

Non-woven paper fabrics of example 1 were immersed into a CFW solution with 10 μM CFW in ethanol (absolutized) and subsequently dried at 40° C. in a vacuum oven for one hour. Later, this staining is used as reference, because CFW due to the high binding affinity to cellulose is homogenously distributed across the non-woven paper fabrics and does not migrate during the drying. The non-woven fabrics labeled such were treated with TEOS solutions and dried such as described in example 2, wherein the immersion solutions, in addition, contained 20 μM rhodamine B.

Bb) Production of the Cross Sections

Each sample was embedded into a mixture of 49.9875% by weight of Desmodur 3200, 49.9875% by weight of Albodur 956 VP and 0.025% by weight of TIB-KAT 318. This mixture is a commercial polyurethane system. The freshly embedded samples were subjected to several vacuum cycles at room temperature for removing remaining air bubbles. Subsequently, the resin was hardened at 80° C. for 18 hours. Then, samples with a thickness of 120 μm were cut. The cutting plane was chosen such that it is orthogonally oriented with respect to both main surfaces.

cc) Confocal Laser Scanning Microscopy

The samples were placed between two round 25 mm microscope cover glasses using type F immersion liquid from Leica. The picture was made with a Leica TCS SP8.

An objective of the type "HC PL APO CS2 20×/10.75 IMM" in water immersion was used, CFW was excited with a 405 nm laser and detected at 415-557 nm. Rhodamine B was excited with a 552 nm laser and detected at 562-753 nm.

For each of the examined non-woven fabrics the data of the images of the different confocal planes were combined and a grey scale analysis was conducted for each series of pixels, that is, that the grey values of each series for each single column were added. From this the distribution through the non-woven fabric from one of the main sides to the other main side was determined.

dd) Results

In the present experimental setup CFW is used as reference value. CFW has high affinity to cellulose and therefore it is uniformly distributed across the whole thickness of the non-woven fabric. When the fluorescence value of CFW across the paper cross section shows considerable fluctuations, then this may be indicative of problems in the ray path (such as, e.g., entrapped air), because physically CFW is homogenously distributed on the paper. But in the case of very low thicknesses of $SiO_2$ layers it may be that amino groups of CFW react with the polyurethane resin, whereby the fluorescence of CFW is deactivated. When, however, CFW is protected by $SiO_2$, then there is no reaction with the resin so that the fluorescence is maintained. Therefore, the extent of the CFW fluorescence in addition to the reference is a measure for the content of $SiO_2$ at a certain depth position within the non-woven fabric.

Rhodamine B (RhoB) is used as ratiometric marker for the portion of $SiO_2$. The higher the RhoB fluorescence, the higher the portion of $SiO_2$.

In the case of the non-woven fabrics which were dried at normal pressure a decrease of the RhoB fluorescence from the upper side of the non-woven fabric to the lower side of the non-woven fabric was detected. Thus, the content of $SiO_2$ within the non-woven fabric decreases from the upper side to the lower side. This effect was observed independently of the portion of TEOS in the immersion solution. In the case of the lowest TEOS concentration, in addition, a tendency of the CFW fluorescence towards lower values was present, which shows that parts of the cellulose fibers were no longer masked.

In the case of the non-woven fabrics which were dried in the vacuum oven such a distribution of the portion of $SiO_2$ cannot be observed, neither in the case of the non-woven fabrics which were treated with low-concentrated TEOS solution nor in the case of the non-woven fabrics which were treated with medium-concentrated TEOS solution or high-concentrated TEOS solution. Instead, a sandwich-like intensity distribution with high fluorescence at the upper and lower sides and low RhoB fluorescence in the interior of the non-woven fabric can be seen. In addition, a constant CFW fluorescence can be seen which suggests that during the drying in vacuum the whole surface of the non-woven fabric is provided with $SiO_2$ at least such that no reaction takes place between CFW and resin. The described sandwich-like distribution of $SiO_2$ arose independently of the portion of TEOS in the immersion solution. But the relative imbalance of the distribution between the surface of the non-woven fabric and the interior of the non-woven fabric was larger, when the portion of TEOS in the immersion solution was lower.

The results show that the hydrophobic properties correlate with the portion of $SiO_2$.

The invention claimed is:

1. A fibrous non-woven paper fabric with asymmetric silica impregnation, wherein the non-woven paper fabric comprises two main surfaces, wherein both of the two main surfaces comprise $SiO_2$, wherein the portion by weight of $SiO_2$ starting from at least one of the two main surfaces decreases continuously from the at least one of the two main surfaces towards the interior of the non-woven fabric, wherein the portion by weight of $SiO_2$ at one of the two main surfaces is at least 4 times higher than the portion by weight of $SiO_2$ at the other of the two main surfaces, wherein the non-woven paper fabric comprises a hydrophobic main surface and a hydrophilic main surface, wherein the impregnated fibrous non-woven paper fabric comprises $SiO_2$ in an amount of 0.1 to 10% by weight of the impregnated fibrous non-woven paper fabric, and wherein the $SiO_2$ is formed in situ within the fibrous structure of the non-woven paper fabric by hydrolysis and condensation of a silicon alkoxide precursor.

2. The fibrous non-woven paper fabric according to claim 1, wherein the portion by weight of $SiO_2$ at the at least one of the two main surfaces is at least 1.1 times as high as the portion by weight of $SiO_2$ in the center of the non-woven fabric.

3. The fibrous non-woven paper fabric according to claim 1, wherein the portion by weight of $SiO_2$ at both of the two main surfaces is at least 1.1 times as high as the portion by weight of $SiO_2$ in the center of the non-woven fabric.

4. The fibrous non-woven paper fabric according to claim 1, wherein the portion by weight of $SiO_2$ at one of the two main surfaces is at least 1.1 times as high as the portion by weight of $SiO_2$ in the center of the non-woven fabric, and wherein the portion by weight of $SiO_2$ at the other of the two main surfaces is at most 0.9 times as high as the portion by weight of $SiO_2$ in the center of the non-woven fabric.

5. A method for the production of a fibrous non-woven fabric according to claim 1, comprising the following steps:

A) providing of a fibrous non-woven fabric,

B) providing of an impregnating solution, wherein the impregnating solution contains a silane component, C) impregnating of the fibrous non-woven fabric with the impregnating solution, D) drying of the non-woven fabric at temperatures in a range of 70° C. to 190° C., wherein there is a period of time of at most 60 seconds between the completion of the impregnating according to step c) and the begin of the drying according to step d).

6. The method according to claim 5, wherein the impregnating solution consists of the silane component so that the portion of the silane component in the impregnating solution is 100% by weight.

7. The method according to claim 5, wherein the silane component is selected from the group consisting of tetraethyl orthosilicate (TEOS), tetramethyl orthosilicate, polydimethoxysiloxane, 1,2-bis(triethoxysilyl) ethane, tetramethyl orthosilicate (TMOS), silicon tetraacetate and mixtures of two or more thereof.

8. The method according to claim 5, wherein the pressure during the drying according to step d) is in a range of 0.1 kPa to 30 kPa.

9. The method according to claim 5, wherein the pressure during the drying according to step d) is in a range of >30 kPa to 500 kPa.

10. The fibrous non-woven paper fabric with asymmetric silica impregnation according to claim 1, which is obtained through a method, comprising the following steps:

a) providing of a fibrous non-woven paper fabric, b) providing of an impregnating solution, wherein the impregnating solution contains a silane component in a range of 0.1% by mol to 3.5% by mol, selected from the group consisting of tetraethyl orthosilicate (TEOS), tetramethyl orthosilicate, polydimethoxysiloxane, 1,2-bis(triethoxysilyl) ethane, tetramethyl orthosilicate (TMOS), silicon tetraacetate and mixtures of two or more thereof, and at least 95% by weight of ethanol, water, and HCl, c) impregnating of the fibrous non-woven fabric with the impregnating solution, d) drying of the non-woven fabric at environmental pressure of 90 kPa to 110 kPa and temperatures in a range of 70° C. to 190° C., wherein there is a period of time of at most 60 seconds between the completion of the impregnating according to step c) and the beginning of the drying according to step d.

11. The fibrous non-woven paper fabric according to claim 1, wherein a source of the silica is selected from the group consisting of tetraethyl orthosilicate (TEOS), tetramethyl orthosilicate, polydimethoxysiloxane, 1,2-bis(triethoxysilyl) ethane, tetramethyl orthosilicate (TMOS), silicon tetraacetate and mixtures of two or more thereof.

12. The fibrous non-woven paper fabric according to claim 1, wherein the fibrous non-woven paper fabric is impregnated with a solution comprising between 1 TEOS:80 EtOH:20 $H_2O$:0.04 HCl and 1 TEOS:20 EtOH:5 $H_2O$:0.01 HCl in molar ratios.

13. The fibrous non-woven paper fabric according to claim 1, wherein the impregnating solution comprises about 1 TEOS:40 EtOH:10 $H_2O$:0.02 HCl in molar ratios.

14. The fibrous non-woven paper fabric according to claim 1, wherein the amount of $SiO_2$ in the fibrous non-woven paper fabric is from about 0.5% by weight to about 5% by weight of the impregnated fibrous non-woven paper fabric.

15. The fibrous non-woven paper fabric according to claim 1, which is used as a packaging material, as a membrane and/or as a paper for the baking paper, paper cups or paper straws.

16. The fibrous non-woven paper fabric according to claim 15, which is used as freezing paper, products that come into contact with foodstuffs selected from the group consisting of paper cups and paper straws, or packaging for materials that are protected from liquid while allowing diffusion of moisture.

17. The fibrous non-woven paper fabric according to claim 1, which is used for plastic-free straws and/or pasteboard cups.

18. The fibrous non-woven paper fabric according to claim 10, which is used as a packaging material, as a membrane and/or as a paper for the use as baking paper, paper cups or paper straws.

19. The fibrous non-woven paper fabric according to claim 18, which is used as freezing paper, products that come into contact with foodstuffs selected from the group consisting of paper cups and paper straws, or packaging for materials that are protected from liquid while allowing diffusion of moisture.

20. The fibrous non-woven paper fabric according to claim 10, which is used for plastic-free straws and/or pasteboard cups.

* * * * *